United States Patent [19]

Apothéloz

[11] Patent Number: 4,677,914

[45] Date of Patent: Jul. 7, 1987

[54] SAFETY DEVICE FOR A SPINNING PROJECTILE FUZE

[75] Inventor: Robert Apothéloz, Greifensee, Switzerland

[73] Assignee: Werkzeugmaschinenfabrik Oerlikon-Bührle AG, Zürich, Switzerland

[21] Appl. No.: 843,226

[22] Filed: Mar. 24, 1986

[30] Foreign Application Priority Data

Apr. 4, 1985 [CH] Switzerland ..... 01480/85

[51] Int. Cl.[4] ..... F42C 15/26

[52] U.S. Cl. ..... 102/233; 102/235; 102/249

[58] Field of Search ..... 102/233, 232, 231, 235, 102/238, 249, 251, 244

[56] References Cited

U.S. PATENT DOCUMENTS

| | | | |
|---|---|---|---|
| 2,457,254 | 12/1948 | McCaslin et al. | 102/238 |
| 3,465,676 | 9/1969 | Simmen | 102/233 |
| 3,670,655 | 6/1972 | Krupa | 102/238 |
| 3,777,666 | 12/1973 | Morel | 102/233 |
| 4,154,169 | 5/1979 | Petiteau | 102/238 X |
| 4,419,934 | 12/1983 | Apotheloz | 102/233 |
| 4,464,991 | 8/1984 | Kaiser | 102/233 |

FOREIGN PATENT DOCUMENTS

| | | |
|---|---|---|
| 1032129 | 6/1958 | Fed. Rep. of Germany . |
| 2097946 | 3/1972 | France . |

*Primary Examiner*—David H. Brown

*Attorney, Agent, or Firm*—Werner W. Kleeman

[57] ABSTRACT

A safety device for a fuze of a spinning projectile comprises a spin acceleration safety element and a firing forward acceleration safety element. The firing forward acceleration safety element contains a ball displaceable by the action of the firing forward acceleration. The spin acceleration safety element employs an escapement or delay mechanism including an asymmetrically structured balance wheel whose center of gravity is radially displaced from its pivot axis such that the escapement or delay mechanism can begin to operate and time out only after the spin acceleration has ceased to be effective.

7 Claims, 4 Drawing Figures

PRIOR ART

SAFETY DEVICE FOR A SPINNING PROJECTILE FUZE

CROSS REFERENCE TO RELATED PATENT

This application is related to the commonly assigned U.S. Pat. No. 4,419,934, granted Dec. 13, 1983, and entitled "Safety Apparatus For A Spinning Projectile Fuze", the disclosure of which is incorporated herein by reference.

BACKGROUND OF THE INVENTION

The present invention broadly relates to a safety device for a fuze of a spinning projectile having an escapement or delay mechanism including a balance wheel.

Generally speaking, the safety device of the present invention is for the fuze of a spinning projectile and comprises an escapement or time delay mechanism having an idle state and an operating state. The escapement mechanism has a balance wheel with a center of gravity and a pivot axis.

A preferred embodiment of the safety device of the present invention is for a spinning projectile having a booster charge and a fuze and defining a projectile axis. The safety device comprises a rotor having a rotor axis radially displaced from the projectile axis and having a safety position and an armed position. The rotor is movable out of the safety position into the armed position when the spinning projectile is fired. The escapement or time delay mechanism cooperates with the rotor and defines means for permitting the rotor to rotate into the armed position after firing of the spinning projectile.

The safety device specifically comprises a first safety element which is responsive to firing forward acceleration and to spin and serves to release the rotor in order to enable it to rotate into the armed or live position, whereas a second safety element, responsive to spin acceleration of the projectile, serves to release the rotor to enable it to rotate the armed or live position.

The safety device is situated in a first housing, i.e. the rotor, the escapement mechanism including the aforementioned second safety element and also the first safety element are located within this first housing and form a unit which can be positioned or inserted between the reinforcement or booster charge and the fuze of the spinning projectile. The first safety element is arranged in a second housing of its own which is installable as an individual unit within the first housing of the safety device.

A known safety device of this general type is disclosed in European Patent No. 0,046,906 wherein there is provided a spin safety element comprising a cylindrical housing in which a spring-loaded insertable piston is located in a bore of the rotor. The piston is displaceable by the projectile spin out of the bore of the rotor against the force of the spring. Three recesses for a blocking or safety mechanism are arranged in the piston. The blocking or safety mechanism protrudes or extends from the first recess into a bore of the cylindrical housing and rests upon a shoulder of the housing of the safety device. The blocking or safety mechanism protrudes or extends from the second recess of the piston only into the bore of the cylindrical housing. In the third recess of the piston the blocking or safety mechanism is located completely in this piston without protruding or extending from this recess.

SUMMARY OF THE INVENTION

Therefore, with the foregoing in mind, it is a primary object of the present invention to provide a new and improved construction of a safety device for a fuze of a spinning projectile which does not exhibit the drawbacks and shortcomings of the prior art constructions.

Another and more specific object of the present invention aims at providing a new and improved construction of a safety device which is of particularly simple construction and operation and in which a separate spin acceleration safety element is no longer required.

Yet another significant object of the present invention aims at providing a new and improved construction of a safety device of the character described which is relatively simple in design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the safety device of the present invention is manifested by the features that the balance wheel is asymmetrically structured such that its center of gravity is displaced from the pivot axis of this balance wheel, and the pivot axis of the balance wheel coincides with the spin axis of the spinning projectile during operation of the escapement or delay mechanism.

In other words, the safety device of the present invention is manifested by the features that the balance wheel has an asymmetrical structure in which the center of gravity is radially displaced from the pivot axis, and the pivot axis coincides with the spin axis of the spinning projectile at least when the escapement mechanism is in the operating state.

A preferred embodiment of the safety device of the present invention is manifested by the features that it comprises a first safety element cooperating with the rotor for releasing the rotor for rotation into the armed position in response to a firing forward acceleration of the spinning projectile and a second safety element cooperating with the rotor for releasing the rotor for rotation into the armed position in response to a firing spin acceleration of the spinning projectile. The safety device also comprises a first housing for accommodating the rotor, and escapement mechanism and the first and second safety elements which conjointly define the safety device. The first housing is structured for insertion as a unit into the fuze of the spinning projectile. The first housing may be inserted or arranged between the booster charge and the fuze of the spinning projectile. A second housing is provided within the first housing for accommodating the first safety element and is structured for installation as a unit in the first housing. The escapement or time delay mechanism comprises a balance wheel having a pivot axis and defining the second safety element. The balance wheel has a structure which is asymmetric to the pivot axis.

The escapement or delay mechanism cannot begin to operate during spin acceleration because of the asymmetrically constructed balance wheel, as will be explained hereinbelow. The spin acceleration thus effectively delays or prevents premature ignition of the projectile fuze, since spinning forces are necessary for operation of the escapement mechanism while, on the other hand, spin acceleration forces prevent the balance wheel from prematurally moving or being set into motion, i.e. beginning to operate or time out.

By using an asymmetrically constructed balance wheel which has its center of gravity radially displaced from the pivot axis, the necessity of the known separated spin safety element mentioned above is obviated. For safety reasons, each projectile fuze must comprise two safety elements which are independent from one another. A first safety element can be used, for example, which is responsive to firing or forward acceleration. A second safety element can be used, for example, which is responsive to projectile spin or spin acceleration. The second safety element can be omitted if the balance wheel is constructed asymmetrically according to the present invention and is therefore itself sensitive or responsive to spin acceleration.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
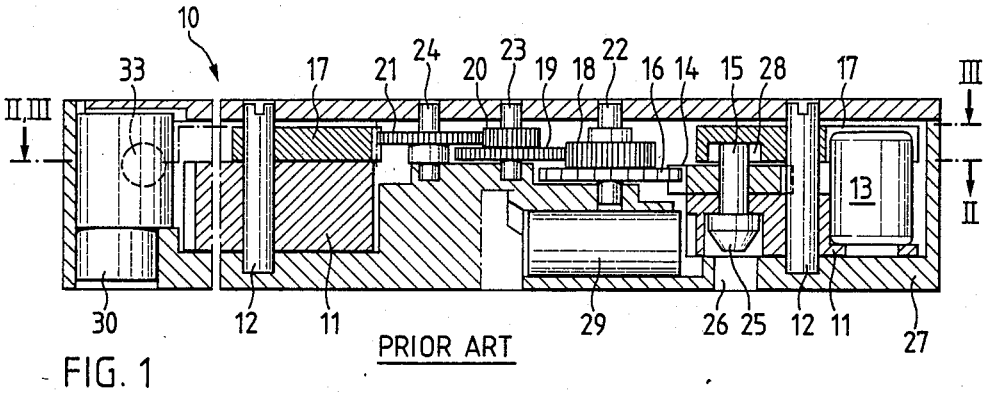
FIG. 1 PRIOR ART
FIG. 1 is a sectional view, taken along the line I—I of FIG. 3, through a safety device according to the prior art.

Describing now the drawings, it is to be understood that to simplify the showing thereof, only enough of the structure of the safety device has been illustrated therein as is needed to enable one skilled in the art to readily understand the underlying principles and concepts of the present invention. Turning now specifically to FIG. 1 of the drawings, the prior art arrangement illustrated therein by way of example and not limitation, will be seen to comprise a safety device 10 containing a rotor 11 (cf. FIG. 2) mounted to be rotatable about a shaft 12 defining a rotor pivot axis. A detonator cap 13 or equivalent structure is mounted in this rotor 11. Furthermore, a balance wheel 14, which can also be described as a swinging or oscillating armature, is rotatably mounted in the rotor 11. This arrangement of the balance wheel 14 can best be seen by referring to FIG. 2. The balance wheel 14 is rotatable about a pivot or journal pin 15 or the like defining a balance wheel pivot axis and which journal pin 15 is axially translatably arranged in the rotor 11 and which, in the showing of FIG. 1, is in its uppermost position. Initially the journal pin 15 is in a lowermost position (not shown). In the unarmed or safety position of the rotor 11 the pivot axis of the journal pin 15 coincides with the spin axis of the projectile as is apparent from FIG. 2.

The balance wheel 14 which is pivotable about the pivot or journal pin 15 coacts with a toothed escape wheel or detent wheel 16 or equivalent structure. During each pivotal movement or swing of the balance wheel 14 the detent wheel 16 is indexed or advanced by one tooth. The detent wheel 16 is driven by a toothed segment or sector gear 17 (cf. FIG. 3) through a gear train which comprises four gears 18, 19, 20 and 21. The gear 18 is fixedly connected with the detent wheel 16. Both the gears 16 and the gear 18 are rotatably mounted about a shaft 22. The gears 19 and 20 are likewise rigidly interconnected with one another and rotatably mounted about a shaft 23. The gear 19 meshes with the gear 18 and the gear 20 meshes with the gear 21. The gear 21 is rotatable about a shaft 24 and meshes with the toothed segment or sector gear 17.

Figure 3:
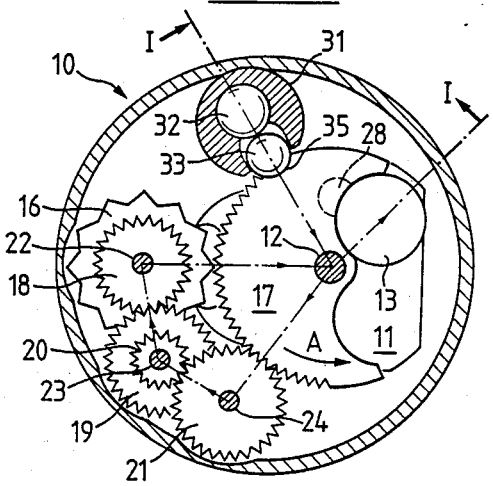
FIG. 3 is a sectional view, taken along the line III—III of FIG. 1, through a safety device according to the prior art.

After firing of the projectile, the toothed segment or sector gear 17, under the action of the projectile spin, rotates out of the position of FIG. 3 in the direction of the arrow A and thus drives, through the gears 21, 20, 19 and 18, the detent wheel 16, with the result that the balance wheel 14 is oscillated or rocked in alternating rotary motion. The toothed segment or sector gear 17 is mounted upon the shaft 12 independent of the rotor 11. As will be evident from FIGS. 1 and 3, the toothed segment or sector gear 17, during its rotation in the counterclockwise direction, can impinge against the detonator cap 13 and can rotate or entrain the rotor 11 likewise in the direction of the arrow A.

The above-mentioned journal pin 15 initially protrudes or extends by means of its cone-shaped head 25 into a bore 26 in a first or outer housing 27 (cf. FIG. 1), so that the rotor 11 is secured against any inadvertent rotation. As soon as the toothed segment 17 arrives at the position shown in FIG. 1, then a bore or recess 28 provided in this toothed segment or sector gear 17 is situated over the journal pin 15, such that, as shown in FIG. 1, the head of the journal pin 15 can be axially translated upwardly into this bore 28. The translatory displacement of the journal pin 15 is caused, on the one hand, by the tendency of the rotor 11 to rotate in the direction of the arrow A due to the action of the projectile spin. Hence, the head 25 of the journal pin 15 is pressed by means of its conical surface against the edge of the bore 26 of the first housing 27, so that the journal pin 15 is axially displaced or translated upwardly into the bore 28 of the toothed segment or sector gear 17 (cf. FIG. 1). On the other hand, the projectile is also retarded or decelerated due to air resistance so that the journal pin 15 tends to move forwardly in any event, i.e. upwardly in the showing of FIG. 1.

Continuing, it will be appreciated that the rotor 11 of the prior art safety device 10 is secured against rotation prior to firing of the projectile by two safety elements 29 and 30. The first safety element 29 is responsive to projectile spin in order to release the rotor 11 into its armed position. The second safety element 30 is responsive to firing or forward acceleration for releasing the rotor 11 into its armed position. Since the first safety element 29 of the prior art device or FIG. 1 is rendered redundant by the present invention, its construction will not be described in more detail here, but reference can be made to the aforementioned U.S. Pat. No. 4,419,934 for further explanations.

Figure 2:
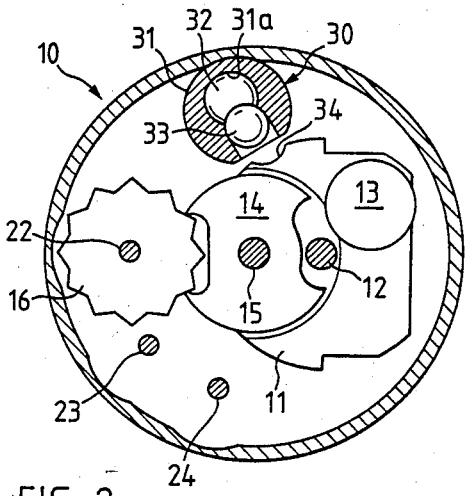
FIG. 2 PRIOR ART
FIG. 2 is a sectional view, taken along the line II—II of FIG. 1, through a safety device according to the prior art.

The construction of the second safety element 30 will be apparent from FIG. 2. According to the showing of FIG. 2 the second safety element 30 comprises a substantially cylindrical second or inner housing 31 in which there is located within a longitudinal bore **31*a* a ball or spherical member 32 which is pressed by the action of a not particularly shown spring against a second smaller ball or spherical member 33. The smaller ball 33 can protrude into a recess 34 of the rotor 11 (cf. FIG. 2) and also into a recess 35 of the toothed segment or sector gear 17, wherein one region of the smaller ball 33 protrudes into the recess 34 of the rotor 11 and another region of the ball 33 protrudes into the recess 35 of the toothed segment or sector gear 17 according to FIG. 3. The operation of the second safety element 30** is explained in more detail in the aforementioned U.S. Pat. No. 4,419,934.

Figure 4:
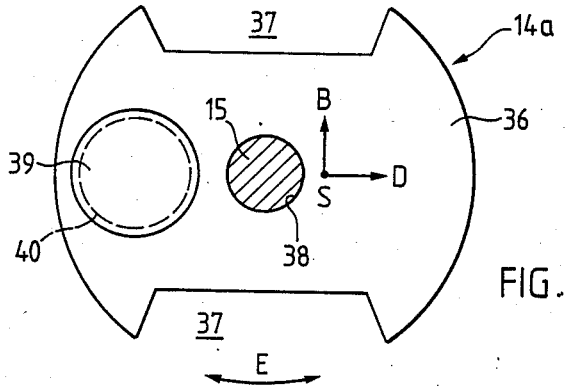
FIG. 4 is an enlarged view of the balance wheel or oscillatory armature of a preferred embodiment of the present invention.

FIG. 4 shows an exemplary embodiment of a balance wheel 14*a* for incorporation for instance in the safety device as otherwise known from the prior art and as illustrated in FIGS. 1, 2 and 3. The inventive balance wheel 14*a* comprises a discoidal or disc-like member 36 having two substantially symmetrical trapezoidal-shaped recesses or cutouts 37 as well as a small central bore 38 through which the pivot or journal pin 15 may extend or protrude in order to allow the inventive balance wheel 14*a* to pivot or oscillate in both pivot directions as indicated by the double-headed arrow E. Additionally, a round or substantially circular recess or cutout 39 is provided for the purpose of displacing the center of gravity S of the balance wheel 14*a* from its center. The center of gravity S is therefore located to the right of the pivot or journal pin 15 in FIG. 4. When an escapement or time delay mechanism such as that of FIGS. 1, 2 and 3 incorporating this inventive balance wheel 14*a* operates, the inventive balance wheel 14*a* is then pivoted or oscillated in alternating rotary directions about the journal pin 15 in the orientation of the double-headed arrow E. Should the escapement or delay mechanism incorporating this inventive balance wheel 14*a* be located in a fuze or a spinning projectile, then upon firing of the projectile, i.e. as long as the projectile is located in the weapon barrel, a spin acceleration force B is effective at the center of gravity S of the inventive balance wheel 14*a*. As soon as the projectile exits the barrel or muzzle of the weapon, then only the radial or centripetal force D is effective which likewise acts upon the center of gravity S of the inventive balance wheel 14*a*. It has been found that the spin acceleration force B is so large that the escapement or time delay mechanism cannot operate and is therefore maintained in an idle state. This means that the escapement or delay mechanism first begins to operate or time out when the spin acceleration force B disappears or ceases upon exit of the projectile from the barrel or muzzle of the weapon, at which time the escapement or delay mechanism assumes an operative state. The centripetal or radial force D is irrelevant since it passes through the pivot axis of the balance wheel 14*a*. This centripetal or radial force D produced by the projectile spin acts radially to the projectile or spin axis while the spin acceleration force B acts tangentially to the journal pin 15, i.e. at right angles to a radius extending therefrom, at the center of gravity S and therefore produces an inertial moment or torque which prevents an oscillating movement of the balance wheel 14*a* as long as the spin acceleration force B is present, i.e. as long as the projectile is still in the weapon barrel.

A supplementary mass or auxiliary member 40 can be attached to the balance wheel 14*a* in lieu of the recess or cutout 39 which likewise would displace the center of gravity S. In this case, however, the center of gravity S would be displaced in the opposite direction.

It is therefore particularly evident that the first prior art safety element 29 can advantageously be replaced by the described preferred embodiment of the inventive balance wheel 14*a*.

While there are shown and described present preferred embodiments of the invention, it is to be distinctly understood that the invention is not limited thereto, but may be otherwise variously embodied and practiced within the scope of the following claims. Accordingly,

What I claim is:

1. A safety device for a fuze of a spinning projectile having a spin axis, comprising:

an escapement mechanism having an idle state and an operating state;

said escapement mechanism possessing an oscillatable balance wheel having a center of gravity and a pivot axis;

said oscillatable balance wheel possessing an asymmetrical structure in which said center of gravity of said oscillatable balance wheel is radially displaced from said pivot axis such that a predeterminate spin acceleration force is effective at the center of gravity of the oscillatable balance wheel which prevents oscillatory motion of the oscillatable balance wheel and thus maintains the escapement mechanism in said idle state during the existence of said predeterminate spin acceleration force; and said pivot axis of said oscillatable balance wheel substantially coinciding with said spin axis of said spinning projectile when said escapement mechanism is in said operating state.

2. The safety device as defined in claim 1, wherein:

said oscillatable balance wheel is asymmetrically provided with a recess for defining said asymmetrical structure in which said center of gravity is radially displaced from said pivot axis.

3. The safety device as defined in claim 1, wherein:

said oscillatable balance wheel is asymmetrically provided with an auxiliary member for defining said asymmetrical structure in which said center of gravity is radially displaced from said pivot axis.

4. A safety device for a fuze of a spinning projectile having a spin axis, comprising:

an escapement mechanism having an idle state and an operating state;

said escapement mechanism possessing a balance wheel having a center of gravity and a pivot axis;

said balance wheel comprising a substantially disk-like member having two substantially symmetrical trapezoidal-shaped recesses;

said balance wheel possessing a substantially central bore;

a pivot pin defining said pivot axis of the balance wheel and extending through said substantially central bore;

said balance wheel possessing a cutout which displaces the center of gravity of the balance wheel; and said pivot axis of said balance wheel substantially coinciding with said spin axis of said spinning projectile when said escapement mechanism is in said operating state.

5. The safety device as defined in claim 4, wherein:

said pivot pin mounting said balance wheel for oscillatory movement about said pivot axis; and said cutout displacing the center of gravity of the balance wheel such that a predeterminate spin acceleration force is effective at the center of gravity of the balance wheel which prevents oscillatory motion of the balance wheel and thus maintains the escapement mechanism in said idle state during the existence of said predeterminate spin acceleration force.

6. A safety device for a fuze of a spinning projectile having a spin axis, comprising:

an escapement mechanism having an idle state and an operating state;

said escapement mechanism possessing a balance wheel having a center of gravity and a pivot axis;

said balance wheel comprises a substantially disc-like member having two substantially symmetrial trapezoidal-shaped cutouts;

said balance wheel possessing a substantially central bore;

a journal pin defining said pivot axis of the balance wheel and extending through said substantially central bore;

an auxiliary member for displacing the center of gravity of the balance wheel; and said pivot axis of said balance wheel substantially coinciding with said spin axis of said spinning projectile when said escapement mechanism is in said operating state.

7. The safety device as defined in claim 6, wherein:

said journal pin mounts said balance wheel for oscillatory movement about said pivot axis; and said auxiliary member displacing the center of gravity of the balance wheel such that a predeterminate spin acceleration force is effective at the center of gravity of the balance wheel which prevents oscillatory motion of the balance wheel and thus maintains the escapement mechanism in said idle state during the existence of said predeterminate spin acceleration force.

* * * * *